US005678777A

United States Patent [19]

Satake et al.

[11] Patent Number: 5,678,777

[45] Date of Patent: Oct. 21, 1997

[54] FLOUR MILLING MACHINE

[75] Inventors: Satoru Satake, Tokyo; Hideki Sakaki; Katsumi Okamoto, both of Hiroshima, all of Japan

[73] Assignee: Satake Corporation, Tokyo, Japan

[21] Appl. No.: 675,676

[22] Filed: Jul. 3, 1996

[30] Foreign Application Priority Data

Jul. 4, 1995 [JP] Japan ..... 7-192459

[51] Int. Cl.[6] ..... B02C 4/02

[52] U.S. Cl. ..... 241/227; 241/230; 241/232; 241/285.3

[58] Field of Search ..... 241/227, 187, 241/230, 231, 232, 233, 285.2, 285.3

[56] References Cited

U.S. PATENT DOCUMENTS

| | | | |
|---|---|---|---|
| 129,238 | 7/1872 | Krom | 241/227 X |
| 666,892 | 1/1901 | Argall | 241/230 |
| 771,949 | 10/1904 | Thomas | 241/231 |
| 1,937,030 | 11/1933 | Middleboe | 241/232 X |
| 2,039,264 | 4/1936 | Seckendorff | 241/187 X |
| 2,909,330 | 10/1959 | Hardinge | 241/231 X |
| 3,409,236 | 11/1968 | Hamilton et al. | 241/232 |
| 4,269,363 | 5/1981 | Entzmann | 241/187 X |
| 4,896,837 | 1/1990 | Heinemann et al. | 241/285.2 X |
| 5,522,557 | 6/1996 | Tiggesbaumker et al. | 241/231 X |
| 5,542,618 | 8/1996 | Andersen | 241/227 |

FOREIGN PATENT DOCUMENTS

| | | | |
|---|---|---|---|
| 729217 | 11/1942 | Germany | 241/227 |
| 897283 | 1/1982 | U.S.S.R. | 241/227 |
| 902805 | 2/1982 | U.S.S.R. | 241/227 |

*Primary Examiner*—Daniel W. Howell
*Assistant Examiner*—Julie A. Krolikowski
*Attorney, Agent, or Firm*—Fish & Richardson P.C.

[57] ABSTRACT

At least a pair of metal rolls having different peripheral speeds with each other are removably mounted to respective rotary shafts in a cantilever form. The axial length of each of the metal rolls is between 100 and 500 mm and the peripheral speed of the high speed roll is between 12 and 30 meter/second. A cover is fitted to a milling chamber that houses therein the paired metal rolls and has a transparent member at least as a part thereof. With such an arrangement, the rolls can be replaced with ease and the milling operation carried out in the milling chamber can be easily monitored through the transparent member.

4 Claims, 8 Drawing Sheets

——— ROLL DIAMETER 250mm, PERIPHERAL SPEED RATIO 2.5:1
PERIPHERAL SPEED OF HIGH SPEED ROLL 20m/s
FEED RATE 10t/h

—·—·— ROLL DIAMETER 250mm, PERIPHERAL SPEED RATIO 2.5:1
PERIPHERAL SPEED OF HIGH SPEED ROLL 8m/s
FEED RATE 5t/h

ROLL DIAMETER 250mm, PERIPHERAL SPEED RATIO 2.5:1
PERIPHERAL SPEED OF HIGH SPEED ROLL 20m/s
FEED RATE 10t/h

ROLL DIAMETER 250mm, PERIPHERAL SPEED RATIO 2.5:1
PERIPHERAL SPEED OF HIGH SPEED ROLL 8m/s
FEED RATE 5t/h

FLOUR MILLING MACHINE

BACKGROUND OF THE INVENTION 1. Field of the Invention

The present invention relates to a flour mill for pulverizing grains and, more particularly, it relates to a flour mill in which each of metal rolls is removably mounted to a shaft in a cantilever form. 2. Description of the Related Art A known flour mill will be first described by referring to FIGS. 1 and 2 of the accompanying drawings. FIGS. 1 and 2 illustrate the so-called duplex type flour mill 57, FIG. 1 schematically showing an external view of the mill and FIG. 2 schematically showing a detailed internal structure thereof. As shown in FIG. 2, two pairs of rolls 51, 52 are arranged symmetrically on both the sides of the machine frame 53. Each of the rolls has an axial length of about 1,000 mm. The inner rolls 51, 51 are high speed rolls that are driven at an enhanced rate of revolution and each of which is rotatably carried at the opposite ends by a pair of fixed bearings 54, 54 that are rigidly secured to the frame 53, whereas the outer rolls 52, 52 are low speed rolls that are driven at a reduced rate of revolution and each of which is also carried at the opposite ends by a pair of movable bearings 55, 55. Each of the movable bearings 55, 55 is swingable around a pivot pin 56 and controlled by a roll gap adjusting means. Each of the rolls 51 is linked to the corresponding roll 52 by engaging a control rod 58 to the corresponding movable bearing 55, the control rod 58 being connected to the corresponding fixed bearing 54 by way of an eccentrically located wheel 61. The left half portion of FIG. 2 shows the state in which the control rod 58 is not engaged with the corresponding movable bearing 55, whereas the right half portion shows the state in which the control rod 58 is engaged with the corresponding movable bearing 55. By the operation of an air cylinder 59 connected to the eccentrically located wheel 61 or a gap adjusting handle 60 connected to the air cylinder 59, the movable bearing 55 is moved toward or away from the fixed bearing 54 so that the gap between the roll 52 and the roll 51 is adjusted.

Since the rolls 51 and 52 gradually wear out as they are used in pulverizing grains, they have to be periodically replaced typically once for every three months.

If the rolls are brake rolls, the flour mill 57 operates optimally for producing good flour when the roll diameter is 250 mm, the peripheral speed ratio is 2.5:1, the peripheral running speed of the high speed roll is about 8 m/sec and the rate of feeding grain to the rolls is about 5 t/h per 1 meter of the length of the rolls.

In the case where the rolls 51 and 52 of the conventional flour mill 57 are to be replaced by new ones, the control rods 58 are first disengaged from the movable bearings 55 to separate the rolls 51 from the respective rolls 52, which are then released from the fixed and movable bearings 54 and 55 as the latter are disassembled. Then, the rolls 51 and 52 are lifted from the body of the mill by means of a winch before new rolls 51 and 52 are brought in. The overall replacing operation is very cumbersome. (Refer to the left half portion of FIG. 2.)

Additionally, since the rolls 51 and 52 of the conventional flour mill are axially as long as 1,000 mm, each of them has to be carried by the bearings 54 and 55 at both the end portions. This forces the milling chamber of the flour mill 57 to be located in the internal space defined by the bearings 54 and 55 arranged on the frame 53, so that the operator of the mill is prevented from directly viewing the inside of the milling chamber to monitor the on-going milling operation.

SUMMARY OF THE INVENTION

In view of the above explained problems existing in the conventional flour mills, it is a main object of the invention to provide a flour mill that allows easy replacement of rolls and direct viewing of the inside of the milling chamber so that the operator can monitor the on-going milling operation.

According to the present invention, there is provided a flour mill having at least a pair of metal rolls having peripheral speeds different from each other for pulverizing grains therebetween, the flour mill comprising:

a machine frame;

a first and a second rotary axis rotatably mounted to the machine frame;

a first metal roll constituting one of the pair of metal rolls and being a low speed roll; and a second metal roll constituting the other of the pair of metal rolls and being a high speed roll with a peripheral speed thereof being 12 to 30 meter/second, the first and second metal rolls defining a milling chamber therebetween, the first and second metal rolls respectively being rotatably and removably mounted to the first and second rotary axes in a cantilever form, and each of the first and second metal rolls having an axial length in a range between 100 and 500 mm.

A part of the cover surrounding the milling chamber defined by the paired rolls may preferably be constituted by a transparent member.

With the above arrangements, since the paired rolls have an axial length between 100 and 500 mm, which is shorter than the axial length of the rolls used in the conventional flour mill, each of the rolls can be safely held in position by mounting it only at an end of the rotary shaft that is rotatably carried by the frame of the mill. The roll can be replaced simply by pulling it out from the rotary shaft and fitting and securing a new one to the rotary shaft, so that the cumbersome operation of disassembling the bearings required for known flour mills is completely eliminated and the entire replacing operation can be carried out easily in a short period of time.

Additionally, since each of the rolls is mounted in a cantilever form with respect to an end of the rotary shaft carried by the frame of the flour mill and the cover of the milling chamber defined by the paired rolls comprises a transparent member as a part thereof, the on-going milling operation carried out within the milling chamber is clearly visible to and can be monitored by the operator.

Further, when the high speed rolls are rotated at its peripheral speed between 12 and 30 m/sec, there is no reduction in the milling efficiency of the above arrangement as compared to that of any known flour mills even though the rolls have an axial length between 100 and 500 mm.

BRIEF DESCRIPTION OF THE INVENTION

The above and other objects, features and advantages of the present invention will be apparent from the following description of preferred embodiments of the invention explained with reference to the accompanying drawings, in which.

Figure 9:
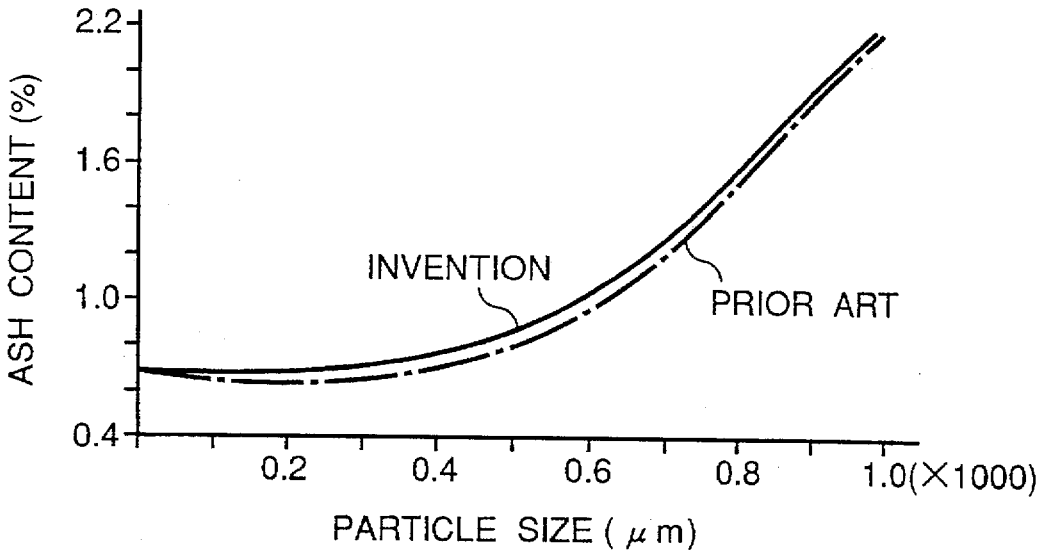
Figure 10:
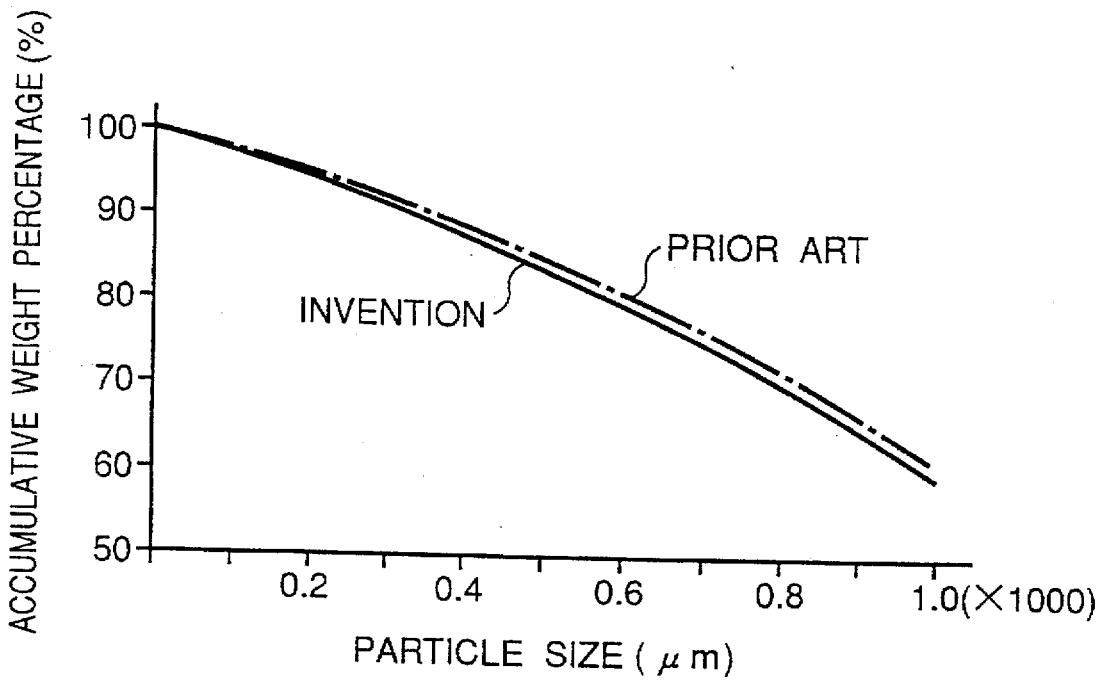

FIG. 9 is a graph illustrating the ash content of the milled flour obtained by a known mill and the ash content of the embodiment of the invention that are different from each other in terms of peripheral speed and grain feeding rate; and FIG. 10 is a graph illustrating the particle size distribution of the milled flour obtained by a known mill and the particle size distribution of the embodiment of the invention that are different from each other in terms of peripheral speed and grain feeding rate.

PREFERRED EMBODIMENTS OF THE INVENTION

Now, the present invention will be described with reference to the accompanying drawings that illustrate a preferred embodiment of the invention.

Figure 1:
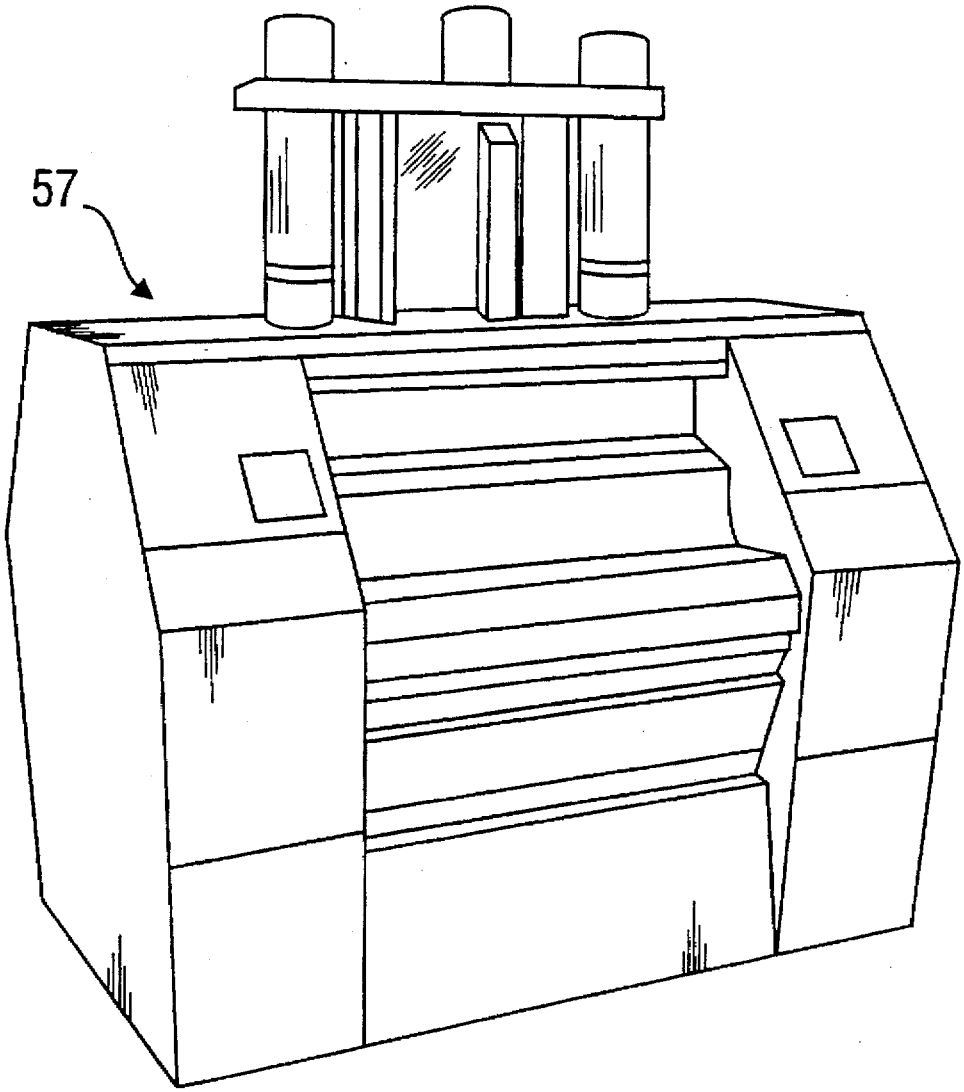
FIG. 1 (Prior Art)
FIG. 1 is a schematic perspective view of a known flour mill.
Figure 2:
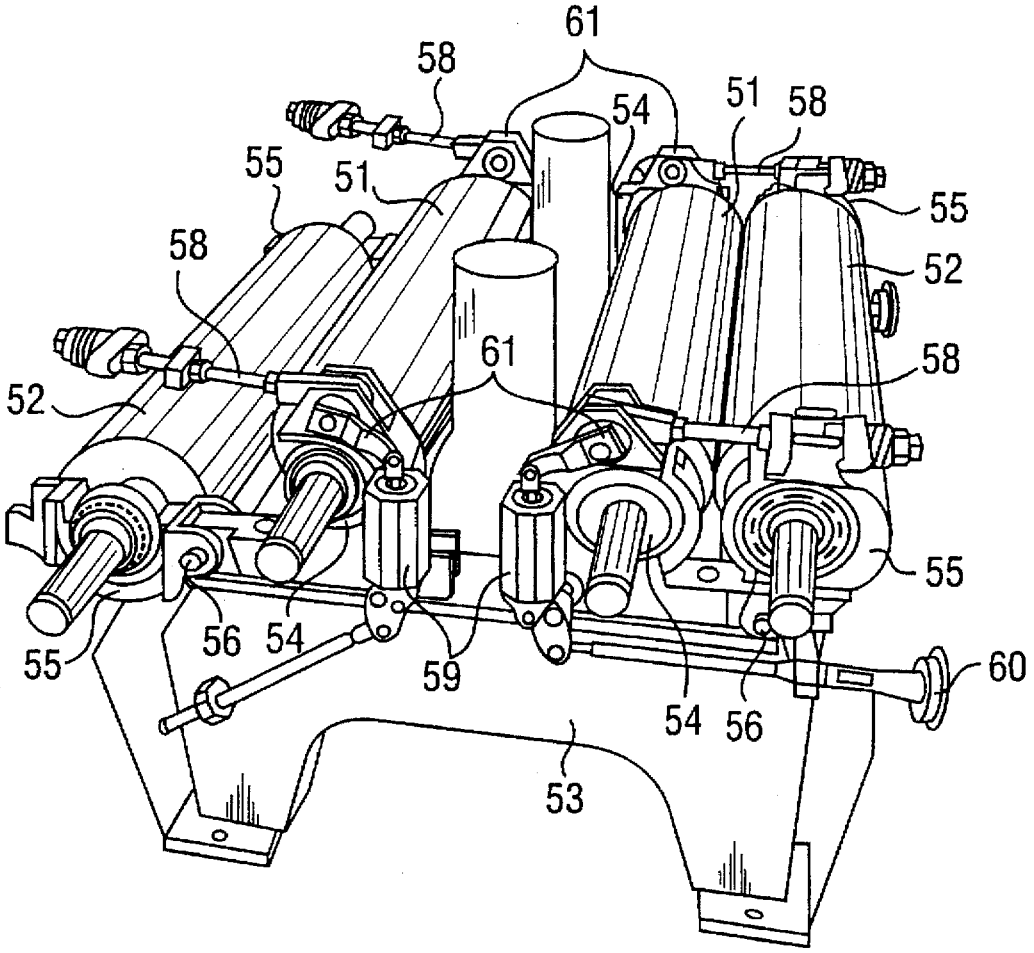
FIG. 2 (Prior Art)
FIG. 2 is a schematic perspective view of the inside of the flour mill of FIG. 1.
Figure 3:
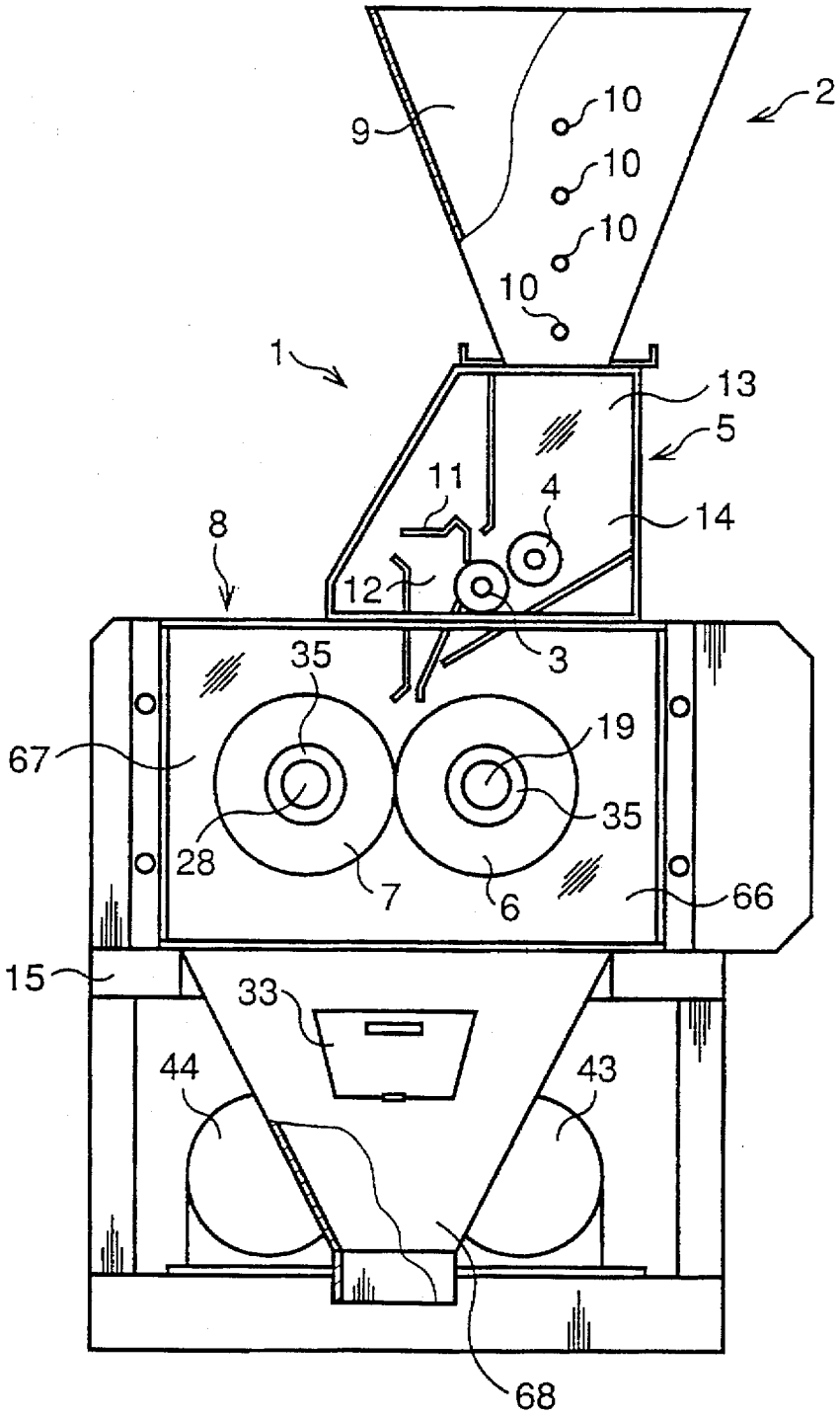
FIG. 3 is a simplified schematic front view of a preferred embodiment of the invention, showing its internal structure.

As best seen from FIG. 3, a flour mill of this embodiment is generally denoted by reference numeral 1 and comprises a grain storing section 2 for storing the grains to be milled; a grain feeding section 5 including a pair of feed rolls 3 and 4 that are driven by a motor; and a milling section 8 including a pair of metal rolls 6 and 7 for pulverizing the grains fed from the grain feeding section 5.

A plurality of grain sensors 10 are arranged longitudinally in a hopper 9 of the grain storing section 2. Each of the sensors 10 outputs an electric signal representing the presence or absence of the grain at the position where the sensor is located. The feed rolls 3 and 4 in the grain feeding section 5 are controlled for their acceleration or deceleration according to the signals outputted from the sensors 10.

A gate plate 11 is arranged on either one of the feed rolls 3 and 4 in the grain feeding section 5 and provided with a gate control cylinder (not shown) so that the gate plate 11 may be positioned between a fully open position and a fully closed position by the operation of the gate control cylinder according to the electric signals from the sensors 10 or the rate of revolution of the feed rolls 3 and 4. A guide chute 12 is vertically arranged next to the feed rolls 3 and 4. The lower end of the guide chute 12 is located above the space between the roll 6 and the roll 7 of the milling section 8. The grain feeding section 5 has a feed chamber 14 that contains the feed rolls 3 and 4 therein and is provided with a transparent cover 13, so that the operator can directly view and monitor the grain feeding operation performed by the feed rolls 3 and 4.

Figure 4:
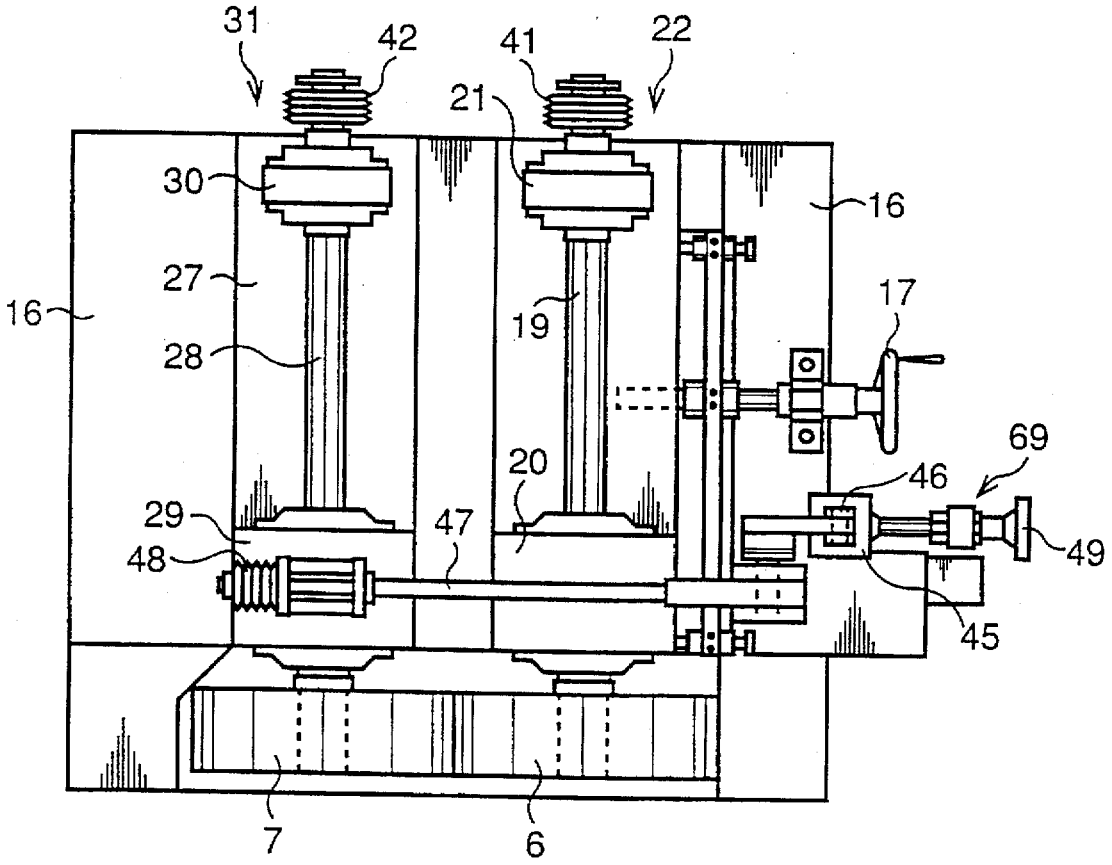
FIG. 4 is a schematic plan view of the embodiment of FIG. 3.
Figure 5:
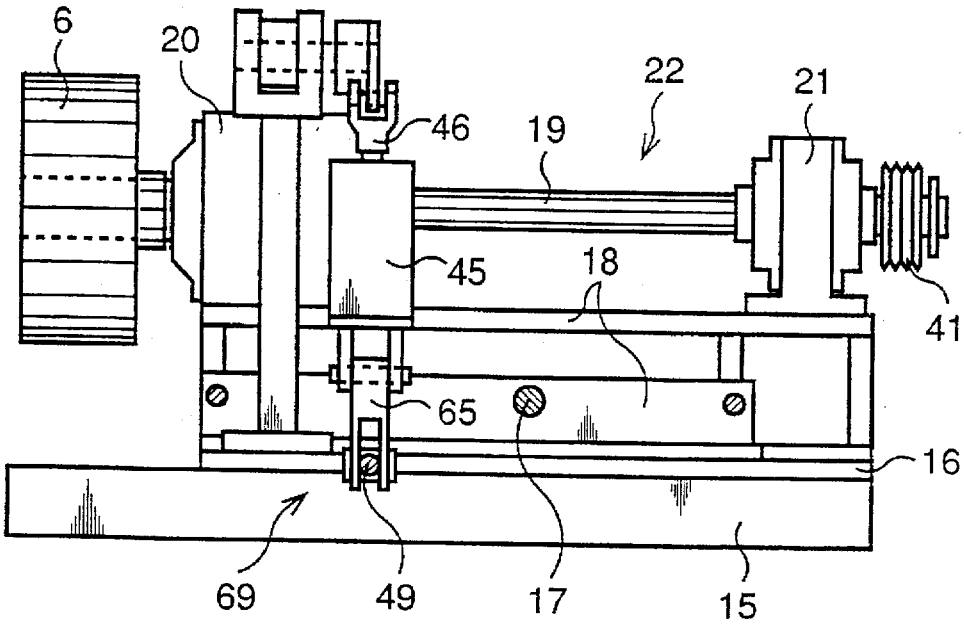
FIG. 5 is a schematic lateral view of the embodiment of FIG. 3.
Figure 6:
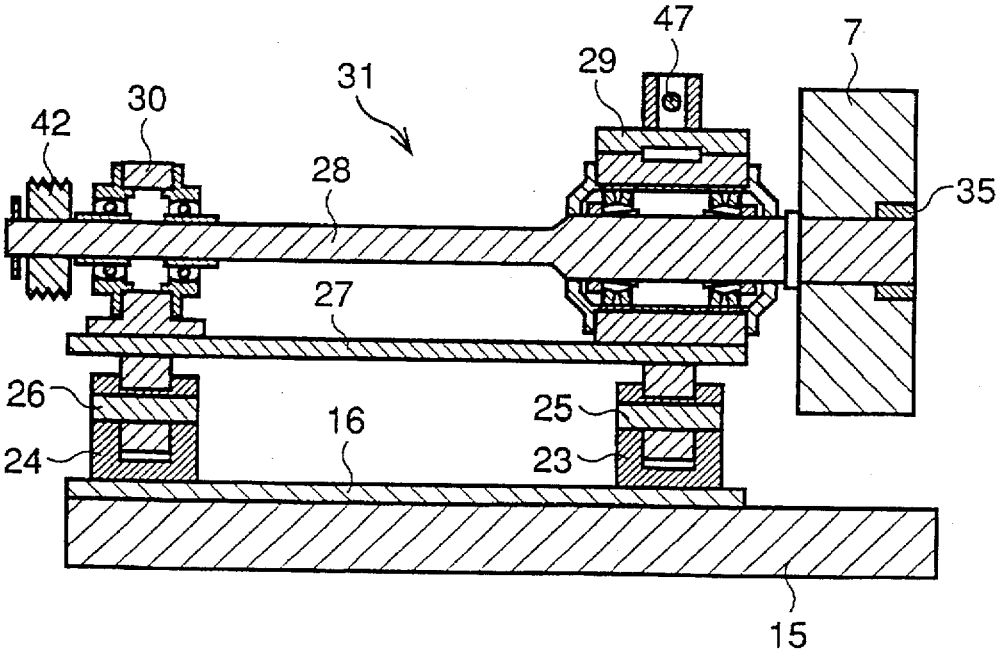
FIG. 6 is a schematic lateral view of the embodiment of FIG. 3, as viewed from the side opposite to that of FIG. 5.

Now, the milling section 8 will be described in detail. As shown in FIGS. 4 and 5, a table 16 is rigidly secured on a frame 15 and slidably carries thereon a sliding table 18 that is operated to slide by means of a control handle 17. A fixed bearing section 22 is arranged on the sliding table 18 and comprises front and rear bearings 20 and 21 for carrying the front and rear portions of a rotary shaft 19. As shown in FIG. 6, a movable bearing section 31 is arranged at a lateral side of the fixed bearing section 22 and comprises beds 23 and 24 rigidly secured to the table 16, fixed shafts 25 and 26 carried respectively by the cradles 23 and 24, a rotatable table 27 rotatably supported on the fixed shafts 25 and 26 and bearings 29 and 30 rigidly secured onto the rotatable table 27 to carry front and rear portions of a rotary shaft 28. The grain milling rolls 6 and 7 each having a diameter of 250 mm and a length between 100 and 500 mm, more specifically 150 mm in this embodiment, are respectively fitted, in the cantilever form, to the front ends of the rotary shafts 19 and 28 and arranged outside the frame 15.

Figure 7:
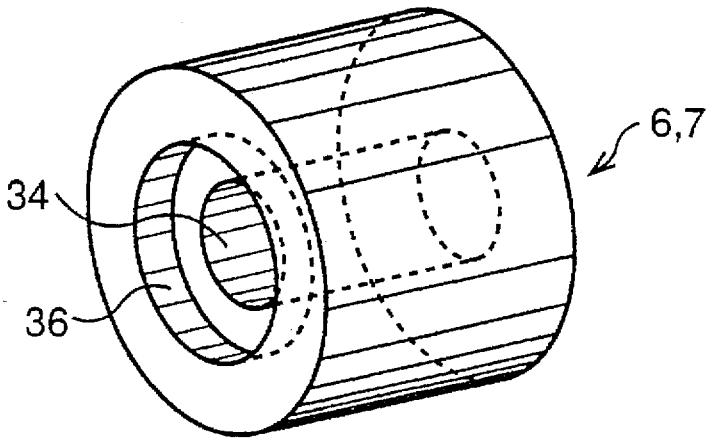
FIG. 7 is a schematic perspective view of a milling roll of the embodiment of FIG. 3.
Figure 8:
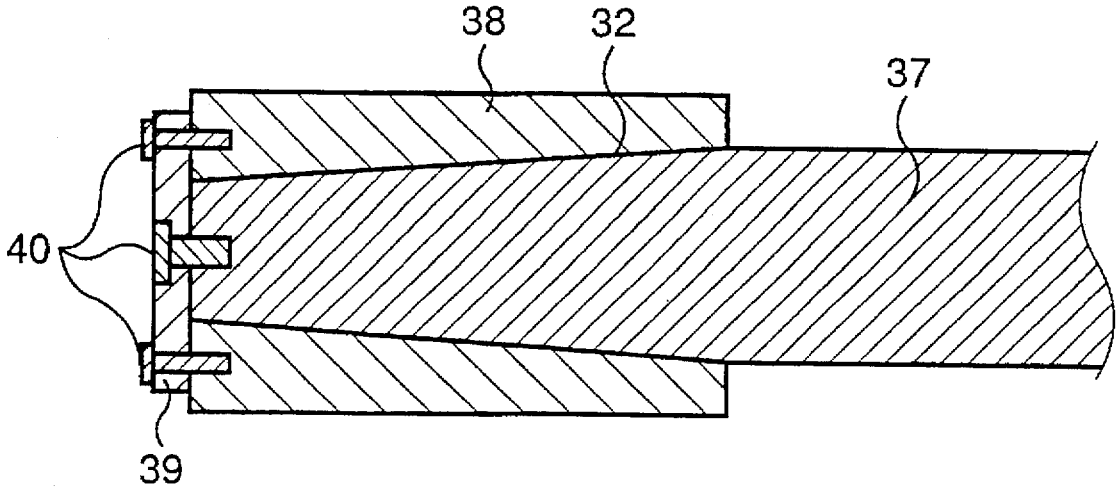
FIG. 8 is a schematic sectional view of the milling roll of FIG. 7, showing how it is fitted to a rotary shaft.

As shown in FIG. 7, each of the grain milling rolls 6 and 7 is provided along its central axis with a shaft receiving hole 34 for receiving the corresponding rotary shaft 19 or 28. Additionally, each of the grain milling rolls 6 and 7 is provided at an end thereof with a recess 36 for receiving an annular locking member 35 (see FIG. 6) for locking the rotary shaft 19 or 28 in position. The locking member 35 is so configured that it is stressed to expand at the outer periphery and contract at the inner periphery when bolts provided on it are driven for being tightened. The rolls 6 and 7 are secured to the respective rotary shafts 19 and 29 as the former are slidably mounted onto the latter with the shaft receiving holes 34, 34 receiving the respective shafts and the locking members 35, 35 are fitted to the respective recesses 36, 36 of the rolls 6 and 7 and driven for tightening. If the rolls are brake rolls that are threaded over the entire peripheral surface, recesses 36, 36 may be formed on the opposite ends of each of the rolls so that the rolls may be selectively fitted reversely to the respective shafts to realize different combinations of thread pitches (e.g., dull and dull, dull and sharp, sharp and sharp, and sharp and dull). If a relatively long roll 38 having a length between 300 and 500 mm is used, the shaft receiving hole 32 and the corresponding end portion of the shaft 37 may be tapered as shown in FIG. 8 so that the shaft 37 and the roll 38 can be secured to each other by means of bolts 40 with a locking member 39 disposed therebetween. In this way, the roll may revolve without any swinging motion.

The rear ends of the rotary shafts 19 and 28 are linked respectively to motors 43 and 44 by way of pulleys 41, 42 and belts. The motor 43 drives the roll 6 on the fixed bearing section 22 to rotate at a peripheral speed of 12 to 30 m/sec, whereas the motor 44 drives the roll 7 on the movable bearing section 31 to rotate at a peripheral speed greater than that of the roll 6 on the fixed bearing section 22. The ratio of the peripheral speed of the high speed roll 6 to that of the low speed roll 7 is typically 1.1 through 3.0 to 1. The ratio is 1.5 through 3.0 to 1 in the case of so-called brake rolls, whereas it is 1.1 through 1.5 to 1 in the case of smooth rolls.

A link rod 47 is arranged above the bearing 29 of the movable bearing section 31 through a spring 48, to drive the rotatable table 27 to rotate around the fixed shafts 25 and 26 in response to upward or downward movement of a rod 46 of a roll holding/releasing air cylinder 45 so that the roll 7 may be moved to and from the roll 6. A crank 65 is pivotably fitted to the lower end of the air cylinder 45 (see FIG. 5) so that the air cylinder 45 may be moved up and down by means of a roll gap adjusting handle 49 in order to finely control the gap between the roll 6 and roll 7 by way of the link rod 47 (see FIG. 4).

As shown in FIG. 3, the rolls 6 and 7 are housed in a milling chamber 67, which is provided with a transparent cover 66 removably fitted to the frame 15.

Reference numeral 68 denotes a collecting hopper for receiving the milled flour in the milling chamber 67 and transferring it to the next station by a conveyor means. Reference numeral 33 denotes a flap door for monitoring the milled flour in the collecting hopper.

When replacing the rolls 6 and 7 of the flour mill 1, the cover 66 is removed from the frame 15 to expose the rolls 6 and 7. Then, the bolts of the locking members 35, 35 disposed in the respective recesses 36, 36 for securing the rolls 6 and 7 respectively to the rotary shafts 19 and 28 are loosened to release and take out the locking members from the recesses 36, 36 and, subsequently, the rolls 6 and 7 are removed from the respective rotary shafts 19 and 28. The rolls 6 and 7 can be fitted to the respective rotary shafts 19 and 28 by reversely following the above steps.

In an experiment, wheat grains are fed for pulverizing to a flour mill according to the invention comprising rolls with a diameter of 250 mm, a peripheral speed ratio of the high speed roll to the low speed roll of 2.5:1 and the peripheral speed of the high speed roll of 20 m/sec at a rate of 10 t/h per 1 meter of the roll and the obtained flour was sifted through a sieve. The ash contents of the coarse particles retained by the sieve were calculated fordifferent particle sizes and compared with the corresponding values obtained by a known flour mill comprising rolls with a diameter of 250 mm, a peripheral speed ratio of the high speed roll to the low speed roll of 2.5:1 and the peripheral speed of the high speed roll of 8 m/sec, to which wheat grains are fed at a rate of 5 t/h per 1 meter of the high speed roll. At the same time the particle size distributions of the milled flour of the two mills were compared (FIGS. 9 and 10). As a result, the ash contents and the particle size distributions of the two mills did not show any significant difference, so that a flour mill according to the invention can be made comparable to a known flour mill when its high speed roll is driven at an enhanced peripheral speed.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. A flour mill having at least a pair of metal rolls having peripheral speeds different from each other for pulverizing grains therebetween, said flour mill comprising:

a machine frame;

a first rotary axis and a second rotary axis rotatably mounted to said machine frame by stationary bearings;

a first metal roll constituting one of said pair of metal rolls and being a low speed roll; and a second metal roll constituting the other of said pair of metal rolls and being a high speed roll with a peripheral speed thereof being 12 to 30 meter/second, said first and second metal rolls being arranged in a milling chamber, said first and second metal rolls respectively being rotatably and removably mounted to respective end portions of said first rotary axis and said second rotary axis in a cantilever form, and each of said first and second metal rolls having an axial length in a range between 100 and 500 mm.

2. A flour mill according to claim 1, wherein said milling chamber defined by said first and second metal rolls is covered by a cover having a transparent member at least as a part thereof.

3. A flour mill according to claim 1, wherein each of said first and second metal rolls has along its central axis a hole for receiving each of said first and second rotary axes and at least at one end thereof a recess portion for receiving a locking member therein.

4. A flour mill according to claim 1, wherein one end portion of each of said first and second rotary axes and an axial hole of each of said first and second metal rolls are tapered.

* * * * *

UNITED STATES PATENT AND TRADEMARK OFFICE

CERTIFICATE OF CORRECTION

PATENT NO. : 5,678,777

DATED : Oct. 21, 1997

INVENTOR(S) : Satoru SATAKE et al.

It is certified that error appears in the above-identified patent and that said Letters Patent is hereby corrected as shown below:

Column 5, line 18, "fordifferent" should be --for different--.

Signed and Sealed this

Twenty-seventh Day of October, 1998

*Attest:*

BRUCE LEHMAN

*Attesting Officer*

*Commissioner of Patents and Trademarks*